United States Patent [19]

Levene et al.

[11] Patent Number: 4,543,862

[45] Date of Patent: Oct. 1, 1985

[54] VACUUM DIE CUTTING APPARATUS FOR FOAM BACKED MATERIALS

[75] Inventors: Martin M. Levene; William W. Lessard, both of Kitchener, Canada

[73] Assignee: Ontario Die Company Limited, Ontario, Canada

[21] Appl. No.: 590,961

[22] Filed: Mar. 19, 1984

[51] Int. Cl.[4] ..... B26D 7/02

[52] U.S. Cl. ..... 83/19; 83/29; 83/31; 83/139; 83/176; 83/451; 269/21

[58] Field of Search ..... 83/29, 31, 451, 19, 83/452, 139, 145, 146, 176, 694, 856; 76/107 C; 269/20, 21, 22

[56] References Cited

U.S. PATENT DOCUMENTS

| | | | |
|---|---|---|---|
| 2,195,819 | 4/1940 | Kurtzeborn | 83/139 |
| 3,250,163 | 5/1966 | Smith | 83/139 |
| 3,294,392 | 12/1966 | Dunham | 83/451 |
| 3,598,006 | 8/1971 | Gerber et al. | 269/21 |
| 3,777,604 | 12/1973 | Gerber | 83/451 |

FOREIGN PATENT DOCUMENTS

| | | | |
|---|---|---|---|
| 356984 | 10/1961 | Sweden | 83/139 |

*Primary Examiner*—Frank T. Yost
*Assistant Examiner*—Hien H. Phan
*Attorney, Agent, or Firm*—Krass & Young

[57] ABSTRACT

A stationary steel rule cutting die for cutting a fixed pattern in each of a plurality of stacked compressible material layers according to the shape of the rule die including a vacuum system for reducing the stack height of the compressible material layers prior to cutting.

9 Claims, 5 Drawing Figures

VACUUM DIE CUTTING APPARATUS FOR FOAM BACKED MATERIALS

INTRODUCTION

This invention relates to steel rule die cutting and particularly to an apparatus which permits the cutting of single and stacked layers of compressible material such as foam plastic by means of a stationary steel rule die.

BACKGROUND OF THE INVENTION

Steel rule dies are commonly used for cutting cloth and clothlike materials such as natural textiles, and synthetic materials such as vinyl. Steel rule dies are particularly advantageous in the repetitive cutting of specific shapes such as shirt collars, automobile interior panels and the like. In brief, a steel rule die typically comprises a base or backing board in which a groove matching the pattern to be cut is formed, and a length of steel rule embedded in the board with a sharpened exposed edge extending therefrom. The die is used in combination with a cutting table and a press which may either be single-cut or progressive feed.

A problem arises when it is necessary or desirable to cut relatively thick but compressible materials such as foam-backed vinyl, foam rubber, and plastic foam. A stack or a particularly thick single layer of such materials is sufficiently unstable that an accurate cut is often not possible using conventional techniques.

One approach to the more accurate cutting of foam materials is disclosed in U.S. Pat. Nos. 3,790,154, 3,765,289 and 3,815,221, all assigned to Gerber Garment Technology, Inc. of East Hartford, Conn. These patents, and other related patents assigned to Gerber, disclose a vacuum table which is used primarily to hold sheet material in place while it is cut by a two-axis single blade jigsaw type cutter. According to these patents a sheet of Mylar or other air impervious material can be placed over a stack of compressible materials such that the vacuum table creates a vaccum under the sheet to pull downwardly on the sheet and maintain the entire stack in a stable, compressed condition during the cutting process in a further Gerber U.S. Pat. No. 4,060,016, the jigsaw type cutter is replaced by a rotatable turret carrying a plurality of blanking dies which are selectively rotated into position and driven downwardly through an air impervious sheet and through the stacked materials to form a stack of cut patterns corresponding to the shape of the particular die selected.

In all of the patented systems the board on which the stacked material is located must be capable of receiving the penetrations of the reciprocating knife as well as maintaining a vacuum for the principal purpose of holding the stack in place and for the secondary purpose of evacuating the volume under the air impervious sheet.

All of these patented arrangements also suffer from the disadvantage that the air impervious sheet is cut in the process of cutting the stacked material layers with consequent loss of vacuum and thereby a loss of stability of the stack. And whereas certain of the Gerber patents describe means for "healing" the cut in the air impervious sheet behind the cutting member, these healing arrangements unduly complicate the overall cutting apparatus and/or are not totally successful in preventing loss of vaccum with a consequent loss of stability of the stack.

BRIEF SUMMARY OF THE INVENTION

The present invention is directed toward the design and use of stationary steel rule cutting dies with air-evacuation compression techniques so as to facilitate and improve the use of such dies to cut compressible materials.

According to a basic feature of the invention, a cutting edge and compressible material to be cut by the cutting edge are placed in a sealed, collapsible chamber; air is evacuated from the chamber to collapse the chamber and compress the compressible material against the cutting edge; and the cutting edge is moved through the compressed material to cut a fixed pattern in the material corresponding to the shape of the cutting edge. Since the cut occurs from within the sealed chamber, the integrity of the chamber is not destroyed in the cutting operation.

According to a further feature of the invention, the cutting edge is defined by a steel rule die including a base and a steel rule upstanding from the base; the compressible material is placed on the sharpened upper edge of the steel rule; and the sealed, collapsible chamber is defined by an air impervious cover sheet placed over the compressible material and over the base of the steel rule die so that, when air is evacuated from beneath the sheet, the sheet is pulled downwardly to compress the material against the sharpened upper edge of the steel rule.

It is to be understood that the die of the subject invention is used in combination with a press of either the single stroke or progressive feed type. In the typical arrangement the base containing the steel rule die is placed on a horizontal support surface with the sharpened edge facing upward, the materials are stacked on top of the die and the press is oriented over the die so as to push the stack of materials against the sharpened edge to perform the cutting action.

In the preferred form a pad or board of relatively soft material such as woven plastic or wood is placed over the stack of material to be cut so that the steel rule edge works against and actually penetrates slightly into the pad or board. In accordance with the invention, the pad or board can be placed either over or under the air-impervious sheet, the former being preferred if advancement, replacement or ease of handling is the principal consideration, and the latter being preferred if eliminating the periodis replacement of the shroud-sheet is the principal consideration.

Where the steel rule die forms a closed figure and the vacuum source is external of the die it is necessary to vent the interior of the closed figure which is defined by the steel rule to the external area of the die. In the preferred form the steel rule die is formed with regular-occuring gaps so as to provide vents to equalize pressure as between the inside and outside of any closed figure formed by the die.

DETAILED DESCRIPTION OF THE SPECIFIC EMBODIMENT

Figure 1:
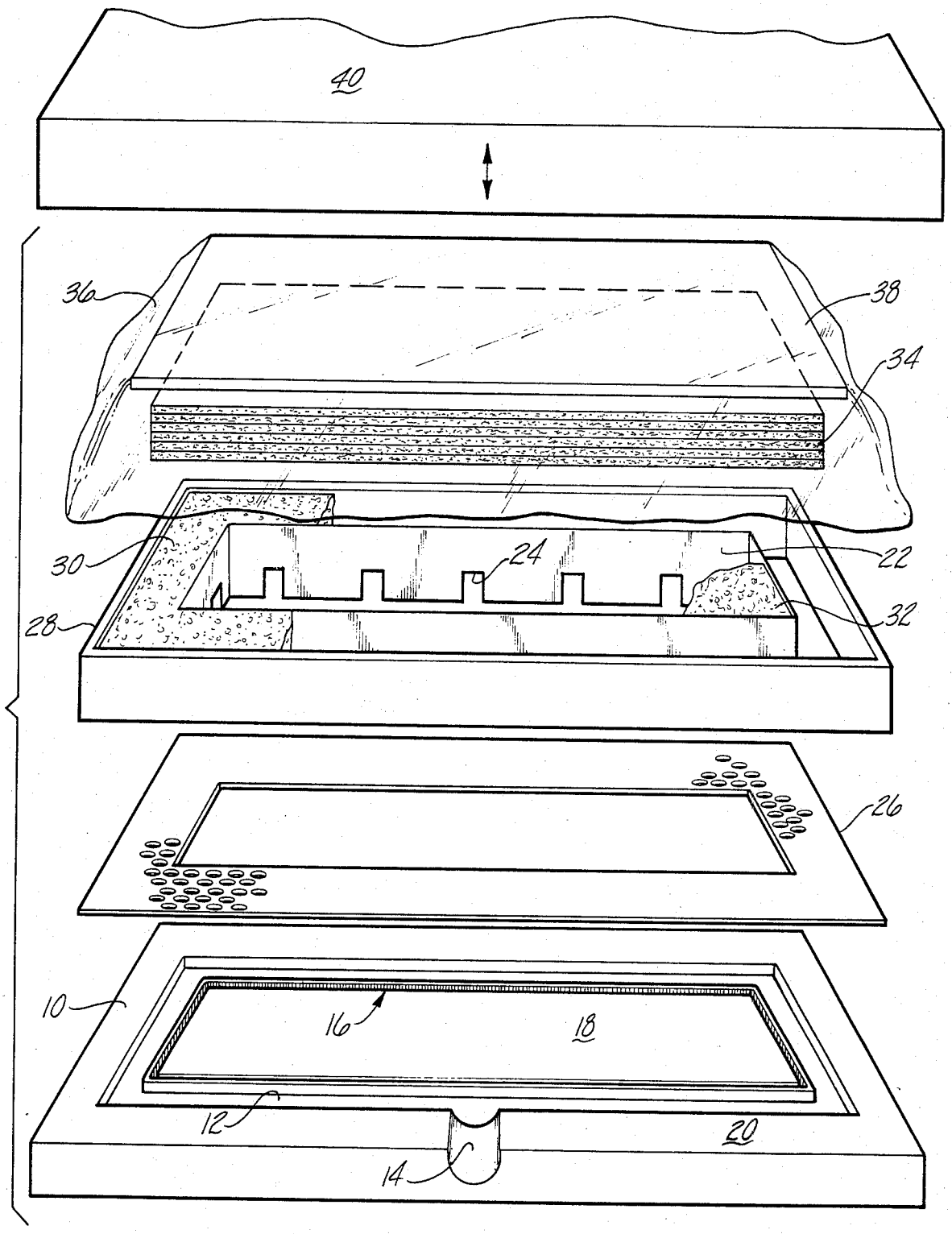
FIG. 1 is an exploded, perspective view of a steel rule die cutting arrangement according to the invention.

Referring to the drawings, the invention is embodied in an apparatus comprising a base 10 of $\frac{5}{8}$" thick plywood board having a wide rectangular groove 12 formed in the upper surface thereof and communicating with a cylindrical channel 14 which extends to the outer edge of the base board 10. The upper surface also has milled therein an inner slot 16 defining major co-planar surfaces 18 and 20.

A steel rule 22 is formed into a rectangular shape congruent with the slot 16 and in the present invention is specially formed to exhibit slots 24 in the bottom or blunt edge thereof for purposes to be described. The steel rule 22 is sharpened and, in some cases, serrated along the upper exposed edge and is driven into the slot 16 of the plywood base 10. In the present instance the die 22 forms a closed figure. Accordingly, the slots 24 are formed in the bottom or blunt end of the rule with a height exceeding the extent to which the rule is driven into the board 10 so as to provide air communication passages between the interior of the figure formed by the rule 22 and the volume represented by the slot 12 in board 10.

Figure 2:
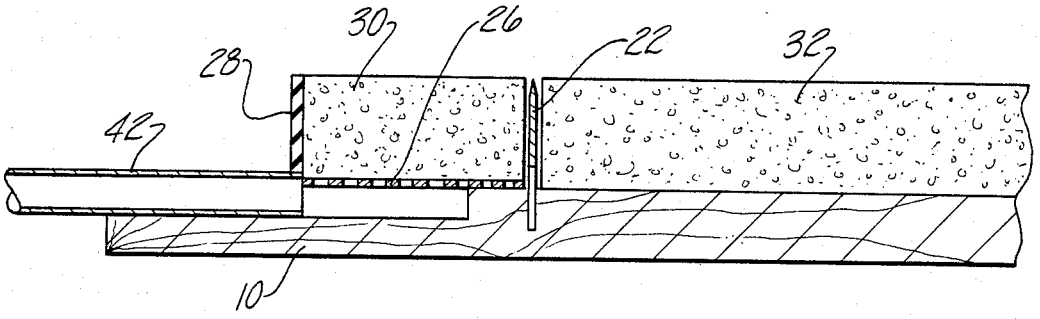
FIG. 2 is a section through part of the apparatus of FIG. 1 showing details thereof.

When rule 22 is in place in the board 10 a perforated plate 26 having a substantially quadrangular configuration is placed over the slot 12 and, as best shown in FIG. 2, extends substantially up to the exterior lateral surface of the rule 22.

In the illustrated embodiment a collar 28 of air tight material such as closed cell plastic or rubber is placed on the surface 20 of the board 10 and is filled in the volume between the collar 28 and the blade or rule 22 with open cell foam 30. Similarly the interior of the figure formed by the rule 22 is filled with open cell foam 32 which rests on surface 18. The foam elements 30 and 32 essentially provide a compressible support surface for a stack 34 of compressible foam materials to be cut using the die shown in the drawing such that the materials do not have to rest directly on the exposed edge of the rule 22. The stack of 34 is then topped with board 38 of plywood or plastic and, finally, covered by a thin, flexible, but air-tight, plastic shroud 36 defining an air-impervious cover which is preferably substantially larger than the die apparatus so as to be capable of extending beyond the lateral boundaries thereof and onto a flat support surface such as one might find in a typical workshop where flatbed die cutting operations are carried on. The board 38 lies between the cutting edge of rule 22 and the sheet 36 to prevent cutting of the sheet and loss of vacuum during the press-cutting operation.

Figure 3:
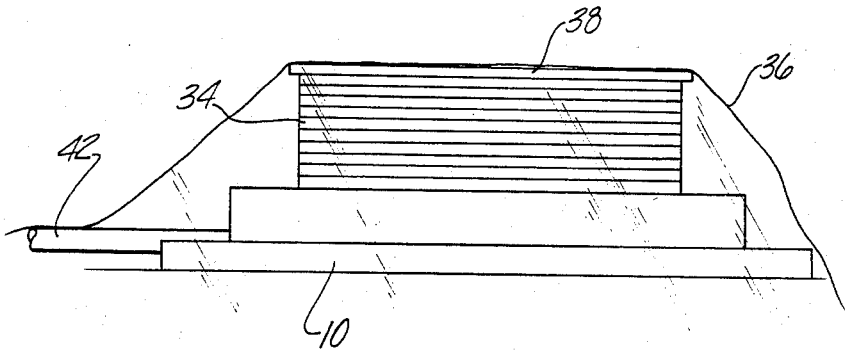
FIG. 3 is a side view of a stack of materials on a die before compression.
Figure 4:
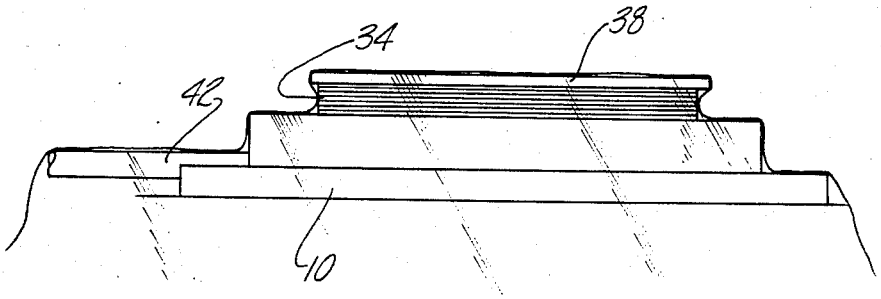
FIG. 4 is a side view of the same stack of materials after compression.

In operation, the assembled die comprising elements 10, 22, 26, 28, 30 and 32 is placed on a flatbed die cutting table and the stack 34 of compressible foam materials is placed in position over the sharp cutting edge of the rule 22. Board 38 is placed over the stack 34. Cover sheet 36 is placed over the assembly and pulled down tight against the surface of the table and a vacuum source is attached to fitting 42 which is placed in the channel 14 shown in FIG. 1. The original uncompressed condition is represented in FIG. 3 wherein the stack 34 may be on the order of five or 6 inches in vertical thickness. The "cutting-ready" condition is represented in FIG. 4 where sufficient air has been drawn out from under the cover sheet 36 to reduce the height of the stack 34 down to about 1" or $1\frac{1}{2}$". At this time the upper press platen 40 is operated to drive the stack 34 down over the blade or rule 22 compressing the plastic foam support materials 30 and 32 until all the layers of material in the stack 34 are cut.

Figure 5:
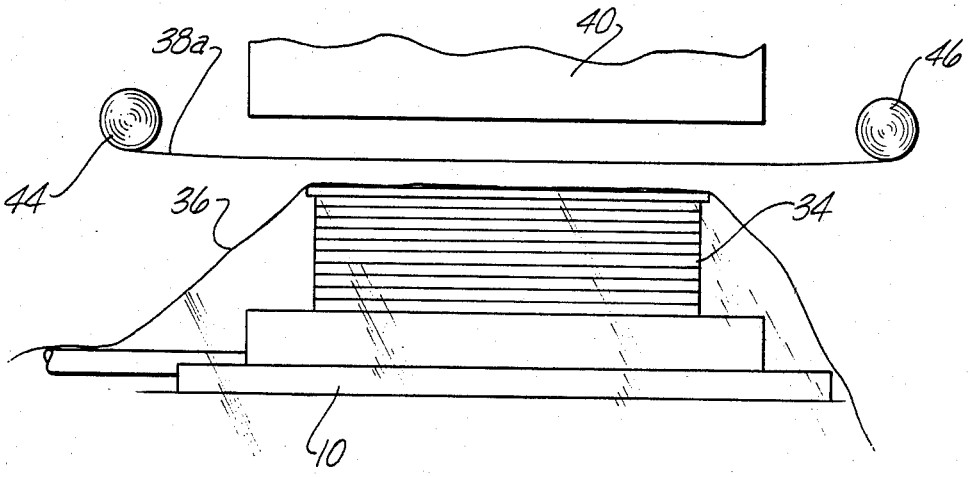
FIG. 5 is a side view of a stack on a die using a belt-type cutting pad.

FIG. 5 shows an alternative embodiment where the steel rule 22 cuts against a belt-type pad **38*a* which is made of woven synthetic material coated/impregnated with urethane or the like to form a tough, somewhat flexible pad. In this case, the pad 38*a* is outside of the shroud sheet 36 such that the sheet is cut by the rule 22 with each operation of press 40. However, this inconvenience is balanced off by the fact that handling of pad 38*a* is made easier by attachment to the press 40 and by advancement thereof between supply and take-up devices 44 and 46**, respectively.

It is to be understood that various modifications and additions to the structure shown in are possible; for example, where the figure defined by the rule 22 is not closed, it is possible to eliminate the slots 24 which provide air communication between the inside and outside of the figure. Another convenience is the use of a spring-biased reel for the vacuum supply base 42 so that it may be paid out and re-reeled as the die is moved along a press pad. For a definition of the invention reference should be had to the appended claims.

We claim:

1. A method of cutting compressible material in a predetermined pattern comprising the steps of:

(a) attaching a steel rule, defining a closed figure to a base with the steel rule extending upwardly to present a sharpened upper edge having a shape conforming to said predetermined cutting pattern;

(b) placing at least one layer of said material over said sharpened upper edge of said steel rule;

(c) covering said at least one layer and said base with an air-impervious cover sheet to form a vacuum chamber between said base and said cover sheet enclosing said at least one layer;

(d) evacuating said vacuum chamber to compress and reduce the thickness of said at least one layer; and (e) pressing said at least one layer onto and through said steel rule to cut said compressed layer in said predetermined pattern.

2. The method of claim 1 and including the further step of:

(f) placing a pad of relatively rigid material over said at least one layer of said material before covering said layer at least one with said cover sheet so that said pad provides a backing against which said sharpened upper edge coacts as said steel rule passes through said layer.

3. A stationary steel rule die for cutting a fixed pattern in each of a plurality of stacked compressible material layers according to the shape of said rule comprising:

a base;

a steel rule, defining a closed figure, attached to said base and extending upwardly therefrom to define a sharp upper edge having the shape of the fixed cutting pattern and adapted to have the stacked compressible material layers to be cut stacked thereon;

air-impervious cover means for covering said base and the stacked compressible material layers overlying said edge to define a vacuum chamber between said base and said cover means enclosing the stacked compressible material layers; and means for evacuating said vacuum chamber to compress and reduce the thickness of the stacked compressible material layers to prepare them for cutting with said rule.

4. Apparatus as defined in claim 13 further including compressible means on said base and adjacent said rule for supporting said compressible material layers at least substantially on said edge.

5. Apparatus as defined in claim 3 wherein said steel rule has at least one aperture formed therein to provide air communication between air inside of the figure formed by said rule and air outside of the figure.

6. Apparatus as defined in claim 5 further including a groove formed in said base adjacent but outside of said the rule and a rigid perforate plate covering said groove.

7. Apparatus as defined in claim 3 further including a layer of relatively rigid but rule-penetrable pad material placed over said stacked compressible material layers and adjacent said air-impervious cover means so as to be acted upon by a press exerting forces tending to drive the stacked compressible material layers onto and through said steel rule.

8. Apparatus as defined in claim 7 wherein said layer of pad material is over said air-impervious cover means.

9. Apparatus as defined in claim 7 wherein said layer of pad material is under said air-impervious cover means.

* * * * *